US009376820B2

(12) United States Patent
Greaves et al.

(10) Patent No.: US 9,376,820 B2
(45) Date of Patent: Jun. 28, 2016

(54) WALKWAY ASSEMBLY

(75) Inventors: John Greaves, Hampshire (GB); Martin Roberts-Jones, Hampshire (GB)

(73) Assignee: KEE SAFETY LIMITED, Berkshire (GB)

( * ) Notice: Subject to any disclaimer, the term of this patent is extended or adjusted under 35 U.S.C. 154(b) by 127 days.

(21) Appl. No.: 13/583,695

(22) PCT Filed: Mar. 9, 2011

(86) PCT No.: PCT/GB2011/000331

§ 371 (c)(1),
(2), (4) Date: Sep. 10, 2012

(87) PCT Pub. No.: WO2011/110810

PCT Pub. Date: Sep. 15, 2011

(65) Prior Publication Data

US 2013/0000231 A1 Jan. 3, 2013

(30) Foreign Application Priority Data

Mar. 10, 2010 (GB) ..... 1003926.1

(51) Int. Cl.

| | |
|---|---|
| ***E04F 11/06*** | (2006.01) |
| ***E04D 13/12*** | (2006.01) |
| ***E06C 1/34*** | (2006.01) |

(Continued)

(52) U.S. Cl.

CPC ..... *E04F 11/06* (2013.01); *E04D 13/12* (2013.01); *E04F 11/0255* (2013.01); *E04F 11/1041* (2013.01); *E06C 1/345* (2013.01); *E06C 1/39* (2013.01)

(58) Field of Classification Search

CPC ... E04F 11/06; E04F 11/1041; E04F 11/0255; E04D 13/12

USPC ..... 52/182, 183, 191, 126.1; 182/93, 95, 97

See application file for complete search history.

(56) References Cited

U.S. PATENT DOCUMENTS 505,343 A 9/1893 Austin
550,370 A * 11/1895 Hartzell ..... 52/191

(Continued)

FOREIGN PATENT DOCUMENTS

DE 25 24 788 12/1976
DE 298 03 959 7/1999

(Continued)

OTHER PUBLICATIONS

International Search Report dated Jun. 24, 2011, corresponding to PCT/GB2011/000331.

(Continued)

*Primary Examiner* — Adriana Figueroa
*Assistant Examiner* — Jessie Fonseca
(74) *Attorney, Agent, or Firm* — Young & Thompson

(57) ABSTRACT

A walkway assembly (10) for attachment to a support structure such as a roof of a building includes a primary support (13) for on-site attachment to the support structure, a plurality of tread modules (41) each attached relative to the primary support and moveable between a first position and a second position at which a part of each tread module is spaced further from the primary support than when at the first position, and at least one riser unit (48) for supporting the tread modules relative to the primary support in at least the second of the first and second positions.

18 Claims, 7 Drawing Sheets

(51) Int. Cl.

| | |
|---|---|
| ***E06C 1/39*** | (2006.01) |
| ***E04F 11/104*** | (2006.01) |
| ***E04F 11/025*** | (2006.01) |

(56) References Cited

U.S. PATENT DOCUMENTS

| | | | | |
|---|---|---|---|---|
| 1,624,721 | A * | 4/1927 | Duke | 52/8 |
| 2,551,345 | A * | 5/1951 | Scott | 52/183 |
| 3,765,137 | A * | 10/1973 | Loix | 52/182 |
| 3,871,479 | A * | 3/1975 | Pelto | 182/86 |
| 4,406,347 | A * | 9/1983 | Stathopoulos | 182/1 |
| 4,586,585 | A * | 5/1986 | Zaner | 182/97 |
| 4,631,880 | A * | 12/1986 | Leicht | 52/105 |
| 4,875,315 | A * | 10/1989 | Champagne | 52/189 |
| 5,189,854 | A * | 3/1993 | Nebel | 52/183 |
| 5,890,330 | A * | 4/1999 | Lesage | 52/183 |
| 6,527,081 | B1 | 3/2003 | Tyner et al. | |
| 6,574,923 | B1 * | 6/2003 | Johnsson et al. | 52/8 |
| 7,934,344 | B2 * | 5/2011 | Truckner | 52/183 |
| 8,316,595 | B2 * | 11/2012 | Burford et al. | 52/183 |
| 2008/0163571 | A1 | 7/2008 | Kohler | |
| 2009/0020360 | A1 * | 1/2009 | May | 182/1 |
| 2011/0239556 | A1 * | 10/2011 | Burford et al. | 52/183 |

FOREIGN PATENT DOCUMENTS

| | | |
|---|---|---|
| FR | 2 606 827 | 5/1988 |
| JP | 10 131444 | 5/1998 |
| JP | 11050623 | 2/1999 |
| JP | 2007092311 | 4/2007 |
| KR | 100674664 | 1/2007 |
| SE | 410 023 | 9/1979 |

OTHER PUBLICATIONS

British Search Report dated Jul. 16, 2010, corresponding to the Foreign Priority Application No. GB1003926.1.

* cited by examiner

WALKWAY ASSEMBLY

This invention relates to a walkway assembly and in particular, though not exclusively, to a walkway assembly for use externally such as on the roof of a building.

The term "walkway" is used herein to relate both to a substantially horizontally extending or slightly inclined surface over which personnel may walk and also to a series of steps which may be in the form of a stairway to assist personnel to move over more steeply inclined surfaces or between two levels.

BACKGROUND OF THE INVENTION

There is a particular need to protect roof structures from damage by maintenance and other personnel moving thereover, and to assist in ensuring the safety of such personnel. Such needs include also the provision of roof-top fire escape routes. In response to these needs it is well known, particularly for industrial and commercial premises, to construct on a roof top both continuous walkway assemblies, which may be level or slightly inclined, and also series of steps in the form of stairways for movement of personnel over more steeply inclined surfaces or between two levels.

The variety of roof pitch angles and the distances over which a walkway is to be provided has meant that in general bespoke on-site construction work is necessary. However the relative difficulties typically encountered when working in a roof top environment, and exposure to weather, makes it particularly advantageous to provide means for minimising or simplifying the on-site construction work.

Another requirement that needs to be taken into account is that of ensuring that the tread surface does not of itself present a significant safety hazard.

Disadvantages of many known walkway assemblies include difficulty of and time for off-site design work, on-site construction, relative expense, cost of component parts and relatively high weight.

SUMMARY OF THE INVENTION

The present invention seeks to provide an improved walkway assembly in which at least some of the aforementioned disadvantages of known types of walkway assemblies and components therefor are mitigated or overcome.

In accordance with one aspect of the present invention there is provided a walkway assembly for attachment or attached to a support structure, said assembly comprising:—

- a primary support for on-site attachment to the support structure;
- a plurality of tread modules each attached relative to the primary support and moveable between a first position and a second position at which a part of each module is spaced further from the primary support than when at the first position, and
- at least one riser unit for supporting the tread modules relative to the primary support in at least the second of the first and second positions.

The primary support may comprise two primary support members which lie side by side in spaced apart relationship and extend in parallel with one another in the direction of the length of the walkway assembly. In this case transverse spacers may be provided to extend between the support members to maintain the support members spaced apart, and/or the tread modules may serve to perform a spacing function. However the primary support may be of a different configuration and may, for example, comprise a single elongate member relative to which the tread modules are attached.

Preferably each tread module is secured pivotally relative to the primary support.

Each tread module may be supported by an auxiliary support that is secured, for example pivotally, relative to said primary support. Said auxiliary support may comprise two auxiliary support members which lie side by side in spaced apart relationship and extend in parallel with one another. As viewed in a direction perpendicular to the primary support, said auxiliary support members may extend substantially parallel with the length of the primary support.

A walkway assembly may comprise a single or a plurality of auxiliary supports.

For forming a walkway to be used as a stairway the walkway assembly, such as a pre-formed module, may comprise a plurality of auxiliary supports and each auxiliary support may be employed to support one or a plurality of tread modules. Said auxiliary supports in this case may each be pivotally secured to the primary support, each for pivotal movement about respective axes which extend substantially perpendicular to the length of the primary support.

If the primary support comprises a pair of spaced apart primary support members, each primary support member may have secured thereto a plurality of auxiliary supports each of a kind comprising a pair of auxiliary support members and with each of the auxiliary support members of a pair being secured to a respective one of the two primary support members. In this case riser units preferably are provided to extend between each of the primary support members and distal regions of each of the auxiliary support members.

For a modular walkway assembly to be used as a traverse walkway to extend substantially horizontally over an inclined roof or other support structure a walkway assembly module may, for example, comprise only a single auxiliary support to which all of the tread modules of the walkway assembly module are secured. In this case said auxiliary support may be secured pivotally relative to the primary support for pivotal movement about an axis which extends substantially parallel with the length of the primary support.

If the primary support comprises a pair of spaced apart primary support members, one primary support member of a traverse walkway may have an auxiliary support pivotally secured thereto and the other primary support may provide location and support for at least one said riser unit which extends to and supports the auxiliary support at a position remote from the primary support member to which the auxiliary support is pivotally secured. As in the case of a stairway module, the auxiliary support may comprise a pair of auxiliary support members that are inter-connected by and provide support for the plurality of tread modules. One of the auxiliary support members may be pivotally secured relative to one of a pair of primary support members and the other auxiliary support member may be inter-connected with the other of said primary support members by one or more said riser units.

From the foregoing description of one aspect of the present invention it will be appreciated that a walkway assembly advantageously, though not necessarily, may be constructed off-site as a pre-formed module and thereby reduce substantially the work needed to be undertaken on-site in conditions which generally are significantly less favourable than off-site. By providing pre-formed modules of different lengths, such as two different lengths (for example 1.5 meter (5 feet) and 3 meter (10 feet) lengths and in view of the fact that on-site tailoring of the length of the walkway often will not be critical to within a few meters, the need to expend time in on-site or off-site cutting to length is avoided or at least significantly minimised. As will also be apparent from the description given below, the primary supports of two modules may be of a kind that readily enables them to be structurally inter-connected thereby to provide a walkway surface devoid of any significant gaps or abrupt changes of deflection characteristics.

A further potential advantage arising from the use of preformed modules is that there is a significant reduction in the need for detailed on-site survey work and measurement. For many applications the only necessary on-site survey work will be that to establish the length of a walkway run and, in the case of a traverse walkway or stairway, the angle of inclination of the support structure and the type of roof surface to which the primary support of the walkway module is to be secured.

The facility for the auxiliary support to be moveable relative to the primary support advantageously allows a module size to be minimised for transportation and, by use of adjustable riser units, for a single module construction to be employed on-site in situations having different angles of inclination to the support structure. However, optionally a module may comprise riser units that can extend to and be lockable at only a single, pre-determined second position. Optionally, alternatively or additionally, a module may comprise riser units that are lockable at the first position, It is not, however, essential that the walkway assembly be of a modular type and the present invention further provides walkway assemblies of a type that are suitable for either modular off-site construction or bespoke on-site construction.

In accordance with another aspect of the present invention there is provided a walkway assembly comprising a pair of primary support members which lie side by side in spaced apart relationship and extend in parallel with one another in the direction of the length of the walkway, and a plurality of tread modules which are each supported relative to the support members, each primary support member comprising a side face which comprises a groove formation for location of the primary support member relative to at least one of a support structure and another support member.

The tread modules may be secured directly to the support members, for example to upper surfaces of the support members, or they may be secured to an auxiliary support that is secured relative to the primary support members. Said auxiliary support may be moveable relative to the primary support members and may comprise one or more of the other features described herein in respect of an auxiliary support.

Preferably each said support member comprises two side faces each having a groove formation.

Preferably the or each said groove formation is provided in a side face which extends substantially perpendicular relative to an upper support surface of the support member.

It is further preferred that the support member has a cross-sectional shape which is symmetrical about two mutually perpendicular axes, for example one parallel with a side face or upper support surface and the other perpendicular relative thereto.

Each groove formation may define a channel which is generally of a C shape in cross section whereby within the groove there are two abutment surfaces each of which lies at a respective side of the groove opening.

Suitable materials for the support members include metals such as aluminium and steel (typically galvanised) and also plastics such as a polyamide (e.g. nylon) or a composite such as glass reinforced polyamide.

The groove formations preferably are open ended to allow for ease of insertion of components such as the heads of securing means, such as bolt heads or nuts employed in use for securing the support member to a connector for connection of two lengths of support members or to a retainer (e.g. a clamp or retention bracket) by means of which the support member may be retained relative to a support structure such as a roof structure.

The support members may be tubular in cross-section. End caps may be provided to close the ends of the tubular passages of the support members and also to serve to provide a protective cover over any sharp edges which may be present at a cut end of a support member. End caps may extend over ends of the groove formations or may leave the groove formations open-ended. The end caps may be of moulded plastics and may be secured in position as a friction fit.

The walkway assembly, whether or not in the form of a module, may comprise straight connectors such as metal strips for joining two lengths of support members end to end, each strip being provided with apertures for securing means. A connector may be secured to a side face of a support member by a bolt the head of which lies within the groove whereby a nut secured to the outer end of the bolt enables a part of the connector to be clamped to one of the support members. A connector may be positioned internally within a groove and may be similarly secured relative to the support member by a securing means that extends outwards through an aperture in the connector, or the connector may be provided with a threaded aperture for engagement by a bolt that extends inwards into the groove. Other shapes of connectors may be used, e.g. right angled connectors or connectors having two limb portions inclined relative to one another at an angle other than a right angle.

Thus it will be appreciated that the provision of a primary support having a said groove formation allows two primary supports readily to be joined end to end or, for example, at right angles relative to one another.

The retainers for attachment to the support structure may be substantially similar to those already well known, but adapted as may be necessary to enable them to be secured readily relative to the grooved side face of a support member.

The tread modules may be of a kind as described in our co-pending UK patent application GB 0921366.1 and entitled Tread Module.

The tread modules preferably are of a kind having a width (as considered perpendicular to the length of the walkway) which is greater than the depth of the module and preferably the width is between four times the depth and twice the depth, more preferably between three times and twice the depth.

Each step of a stairway may comprise only one or a plurality of tread modules. The tread modules may be of a kind severable to form a sub-module as described in our aforementioned patent application. One or more sub-modules, with one or more whole tread modules, may be provided at a step position so as to provide an appropriate depth of tread surface for the particular angle of inclination of the stairway. Similarly, a horizontal walkway section may comprise a plurality of whole tread modules and one or more sub-modules.

For a walkway which is to extend over a roof or other support structure which lies at a significant angle of inclination the present invention teaches that primary support members may be positioned substantially parallel with and be supported by the inclined surface and that riser units are employed to enable tread modules to be supported in the substantially horizontal orientation, for example to be supported on one or more auxiliary supports. Similarly riser units may be employed to form a stairway that connects between two levels without the presence of an inclined surface for support of the primary support members. For forming a walkway that traverses horizontally over an inclined roof structure riser units may be employed to locate one of a pair of auxiliary support members at a position elevated above the roof surface.

The riser units may be of adjustable effective length and may be employed in the formation of a stairway assembly that does not necessarily incorporate support members having a grooved side face.

Thus in accordance with another aspect of the present invention there is provided a walkway assembly for movement of personnel over an inclined surface or between two levels, said walkway assembly comprising a pair of primary support members which lie side by side in spaced apart relationship and extend in parallel with one another in the direction of the length of the walkway, and a plurality of tread modules which each extend between and are supported relative to the primary support members, one edge of each tread module lying closer to one or each of the primary support members than an opposite edge of the tread module and said plurality of tread modules being supported by riser units each of which is of an articulated type comprising two leg sections the relative angle of which is selectively adjustable The end of one leg section of each riser unit preferably is pivotally securable to a support member lying on and or supported by the support structure and the end of the other leg section is pivotally securable relative to the tread module, e.g. an auxiliary support member to which the tread module is secured. The riser unit preferably possesses the further feature that the other ends of the two leg sections comprise pivot positions whereby the leg sections may pivot relative to one another, and locking means may be provided to enable the two leg sections to be locked either parallel with one another or at a chosen angle of relative inclination whereby the effective length of the riser unit may be adjusted to that required to enable the or each tread module to be supported in a substantially horizontal orientation.

Optionally one or each of the leg sections may be provided with a plurality of pivot positions, such as the positions of pivot pin apertures, whereby for a given angle of relative inclination of the leg sections the effective length of the riser unit may be adjusted.

The locking means may comprise for example a retention pin or nut and bolt which extends through an aperture provided in one leg section at a position off-set from the pivot position in said other end of the one leg section and one of a series of apertures provided in said other end of the other of the two leg sections, said series of apertures comprising apertures each off-set from the pivot position of that leg section and said apertures of the series being circumferentially spaced from one another about said pivot position. In consequence by appropriate selection of that aperture of the series through which the locking means extends the selected effective length of the riser unit may be secured against further relative movement of the leg sections under the action of loads carried by the tread module(s).

The riser units may be of a type that limit the maximum angle of movement of tread modules away from the primary support member.

In the case of a stairway assembly module the riser units may be of a type which can adopt a first position in which they allow the outer, leading edge regions of one tread module to lie in an overlapped manner over the inner edge of a neighbouring tread module.

A tread module positioned on an inclined surface may be supported by an auxiliary support member of a kind having a side face with a grooved formation substantially as described herein for the aforementioned support members whereby the end of one leg section of a riser unit may be secured to that auxiliary support member.

For a walkway assembly in the form of a stairway the tread modules (and including any sub-modules) may each be supported by a pair of auxiliary support members one end of each of which is secured, e.g. pivotally, to a primary support member which lies substantially parallel with the surface of the inclined support structure (or extends between two levels) and the distal end region of which is secured to an end of said riser unit.

For a walkway assembly which is in the form of a substantially horizontally extending walkway that extends over an inclined support structure the riser units may be employed to support an outer auxiliary support member that extends parallel with the length of the walkway to support outer regions of tread modules. The inner ends of the tread modules may be supported by another auxiliary support member that serves as an inner support member to support regions of the tread modules nearest the inclined support structure. That inner auxiliary support member may be pivotally secured to support members which lie substantially parallel with the surface of the inclined support structure.

An auxiliary support may be secured to a primary support by pivot means that is attached to a surface of the primary or auxiliary support which is in a plane substantially parallel with a tread module surface or surface of a support structure. However, and especially if the primary and/or auxiliary support comprises a support member having a side face which comprises a groove formation, the pivot means may be secured to said side face.

For forming an installation comprising a substantially horizontally extending walkway and a stairway, and irrespective of whether the horizontal walkway and stairway are aligned in a common direction or, for example, extend at right angles relative to one another, a tread module of the stairway may be arranged to form a part of the walkway or a tread module of the walkway may be positioned to serve as an upper or lower tread of the stairway.

BRIEF DESCRIPTION OF THE DRAWINGS

Embodiments of the present invention will now be described, by way of example only, with reference to the accompanying diagrammatic drawings in which:—

DETAILED DESCRIPTION OF THE PREFERRED EMBODIMENTS

Figure 1:
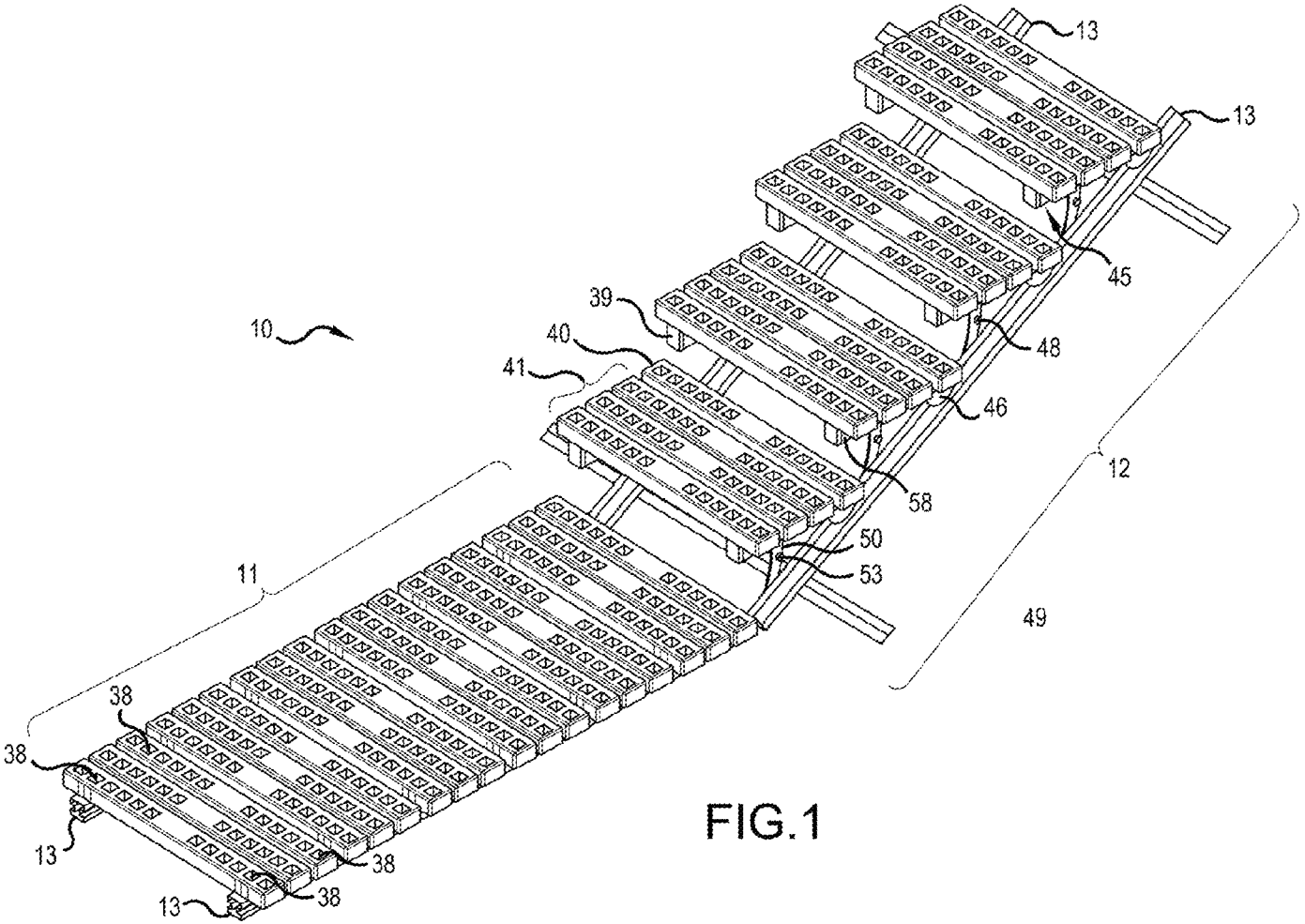
FIG. 1 is a perspective view of part of a walkway installation in accordance with the present invention.

A walkway 10 (see FIG. 1) for a support structure in the form of roof comprising a flat section and an inclined section comprises a horizontal walkway assembly module 11 and a stairway assembly module 12.

The walkway and stairway assemblies 11,12 each comprise a pair of mutually parallel primary support members each in the form of a beam 13, the two support beams lying side by side in spaced apart relationship.

Figure 2:
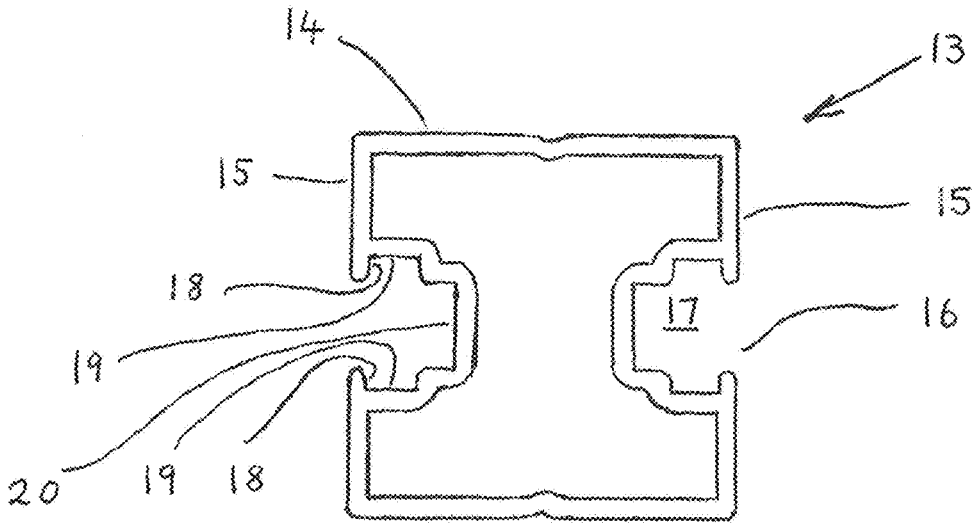
FIG. 2 is a cross-sectional view of a support beam of the assembly of FIG. 1.

Each beam 13 (see FIG. 2) is an aluminium extrusion comprising an upper support surface 14 and a pair of side face walls 15 each of which is grooved such that in each side wall there is an opening 16 to a substantially C shaped retention channel 17 as viewed in transverse cross-section.

The channels 17 in each side face are of the same cross-sectional shape and comprise a pair of abutment surfaces 18 disposed respectively above and below the opening 16. The cross-section of each channel departs from an exact C shape in that the channel has upper and lower recess regions 19 whereby, for a purpose described below, a rectangular-section plate may locate and be supported in upright manner in the channel. Additionally the base region 20 of each channel defines a recess that may, for example, accommodate the head of a bolt that extends through an inserted plate and outwards of the opening 16, and may act to prevent rotation of the bolt head.

Figure 3A:
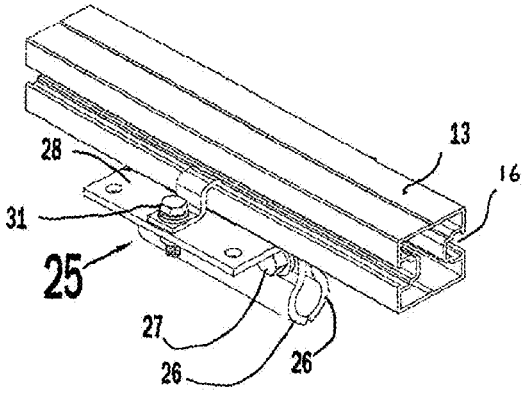
FIGS. 3*a* & 4*a* each show means for securing a support beam to a roof structure.
Figure 3B:
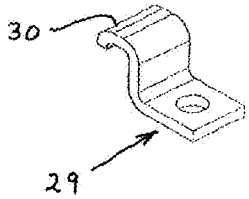
FIGS. 3*b* and 4*b* show exploded views of features of FIGS. 3*a* and 4*a*, respectively.

In the case of a roof or other support structure that comprises a rib formation, such as a standing seam, the beams may each be secured to the roof by clamps 25 (see FIG. 3) comprising in cross-section a pair of limbs 26 which can be clamped together by bolts 27 to embrace the rib. One of the limbs has an integral flange formation 28 to which is secured a clip 29 having a hook shaped end 30 that fits in the beam opening 16 thereby to secure the beam against the flange formation when a nut 31 is tightened to draw the clip downwards towards the flange formation.

Figure 4A:
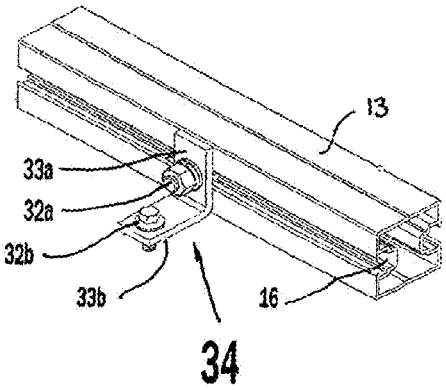
Figure 4B:
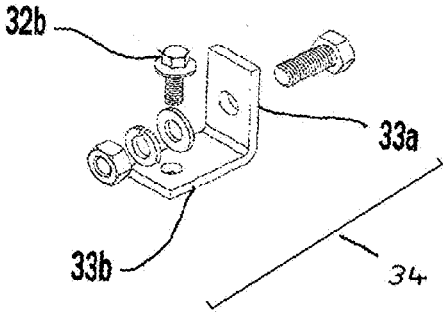

In the case of a roof structure having a surface to which a retainer bracket may be bolted, the channel of a beam may be used non-rotatably to locate a bolt 32*a* that extends outwards and through one limb 33*a* of an L shaped bracket 34 (see FIG. 4) to enable the bracket to be bolted firmly to the beam. The other limb 33*b* of the bracket is formed with an opening to enable the bracket to be secured by a bolt or self-tapping screw 32*b* to the roof structure.

Figure 5A:
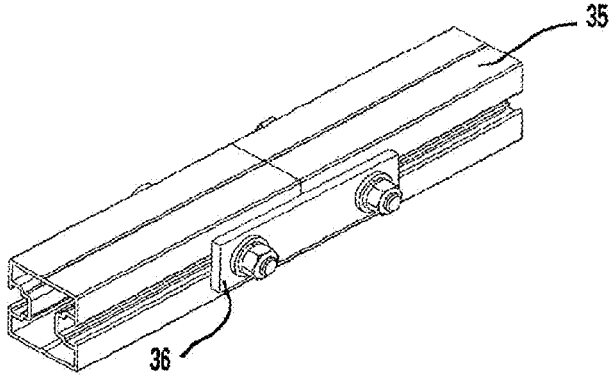
FIGS. 5*a* and 5*b* show means for connecting two support beams end to end, FIG. 5*b* showing an exploded view of a feature of FIG. 5*a;*
Figure 5B:
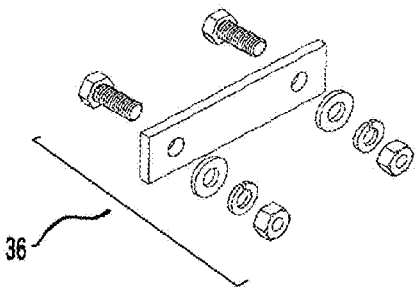
Figure 6A:
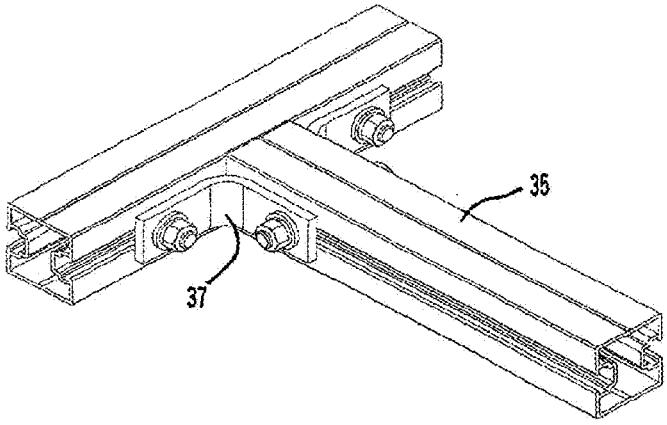
FIGS. 6*a* and 6*b* show means for securing two support beams at right angles relative to one another, FIG. 6*b* showing an exploded view of a feature of FIG. 6*a;*
Figure 6B:
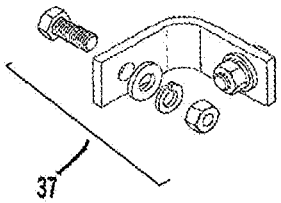

In addition to facilitating ease of attachment of a primary support beam to a roof structure the grooved side walls also facilitate ease of connection of two lengths of the beam in an end to end manner or to form a right angled interconnection, such as a T junction, between two lengths as shown respectively in FIGS. 5 and 6. In each of FIGS. 5 and 6 a first beam section 35 has secured thereto a connector 36 or 37 by means of a bolt the head of which is non-rotatably secured in the channel recess 20 with the outer end of the bolt being accessible for location of a nut to enable the connector to be tightened against the beam side wall. In the case of FIG. 5 the connector is in the form of a flat plate having two apertures whereby it may serve to interconnect between two bolts provided respectively in ends of the two lengths of beam. In the case of FIG. 6 each connector is an L shaped right-angled bracket to enable a T section junction to be created.

Prior to or, or optionally, after securing the beam sections to a roof or other support structure tread modules 41 (see FIG. 1) are secured to the upper surfaces 14 of the beams by means of self tapping screws which locate in recesses 38 in the tread modules. These tread modules may, for example, be of the kind described in our aforementioned co-pending UK patent application GB 0921366.1.

In this embodiment the angle of inclination of the stairway 12 is such that a single module 41 would not provide a suitable depth of tread. Thus at each step position there is provided a whole module and a one third sized sub-module section 40 which has been formed by cutting of a whole module.

The stairway assembly 12 comprises a pair of spaced apart beams 13 secured to the inclined surface of the roof structure in a manner as aforedescribed for the horizontal walkway assembly 11.

Figure 7:
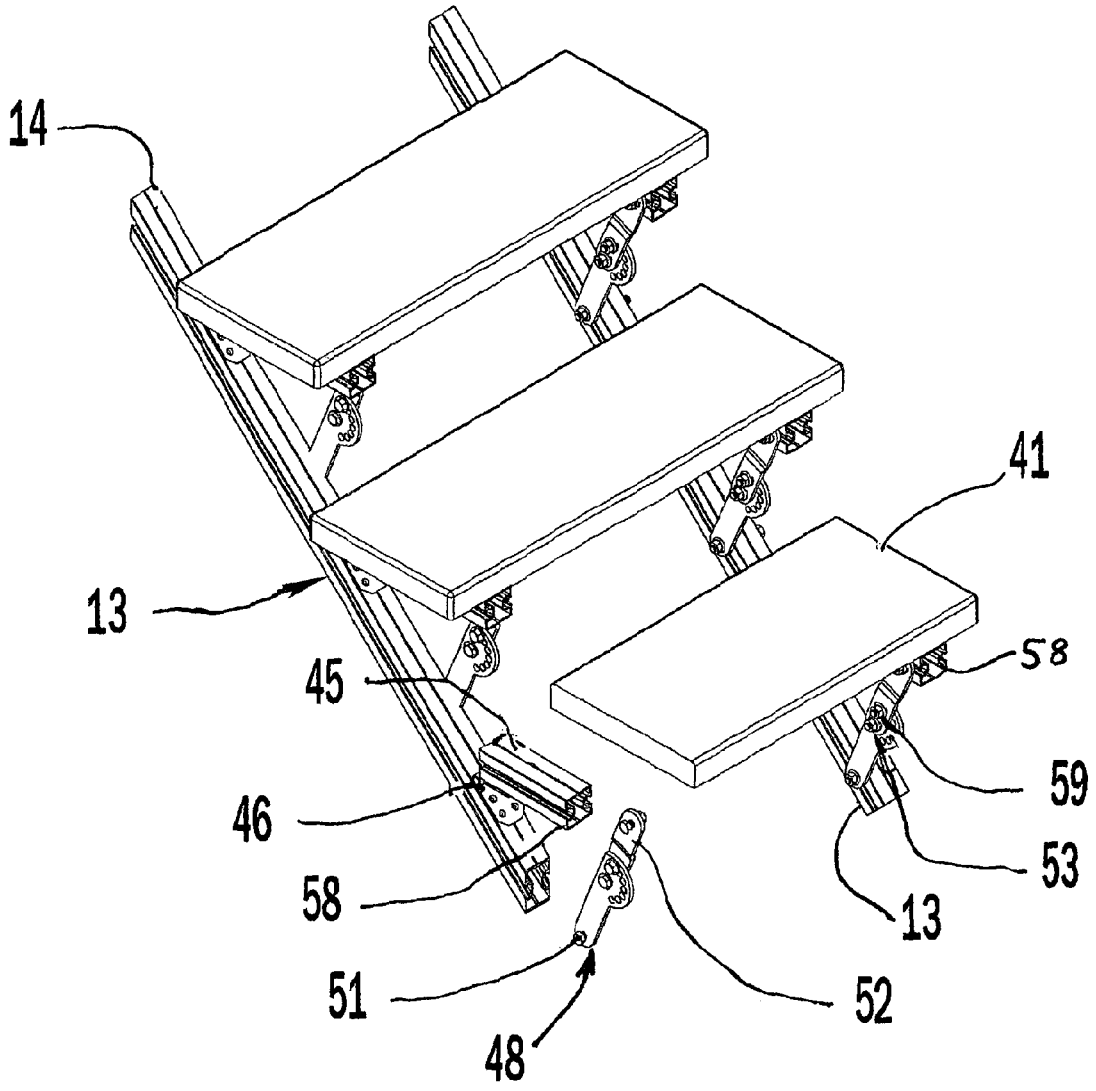
FIG. 7 shows part of the stairway of FIG. 1.
Figure 8:
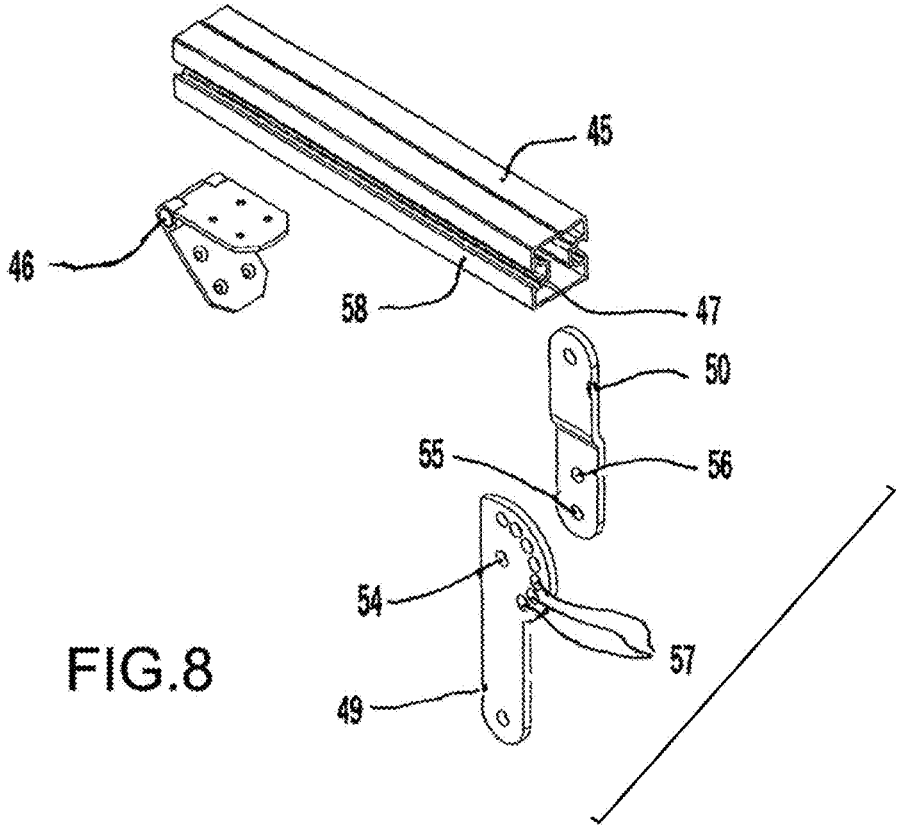
FIG. 8 shows in exploded form components of the stairway of FIG. 7.

For each tread position (see FIG. 7) each beam has an auxiliary support beam 45 secured thereto. Each auxiliary beam is secured pivotally relative to a support beam 13 by means of a hinge 46 (see FIGS. 7 and 8) the arms of which are secured by self-tapping screws respectively to an upper surface 14 of a beam and underside surface 47 of auxiliary beam 45. Exposed ends 58 of each auxiliary beam 45 are covered by protective end caps 39 which are each an interference fit in the end of a beam.

The distal end 58 of each auxiliary beam 45 is supported by an articulated riser unit 48 comprising two leg sections in the form of pivotally interconnected arms 49,50 one, 49, of which is pivotally connected and secured to the beam 13 and the other arm 50 being pivotally connected and secured to the distal end 58 of the auxiliary beam 45.

The ends of the leg sections are secured by bolts 51,52 respectively to the support beams 13 and distal end regions 58 of the auxiliary beams 45.

The leg sections are each pivotally interconnected by a nut and bolt assembly 53 that extends through pivot apertures 54,55.

When the arms are at a chosen angle of relative inclination they are locked relative to one another by a lock pin 59 inserted through a second aperture 56 in one leg section and which is aligned with one of a series of apertures 57 provided in the other leg section and circumferentially spaced relative to the pivot aperture 54.

Accordingly, the facility for varying the relative inclination of the leg sections of each riser unit, the position at which an end is secured to a support beam 13, and, optionally, also to the auxiliary beam 45 provides for ease of on-site adjustment to ensure that the tread modules 41 are acceptably level.

Figure 9:
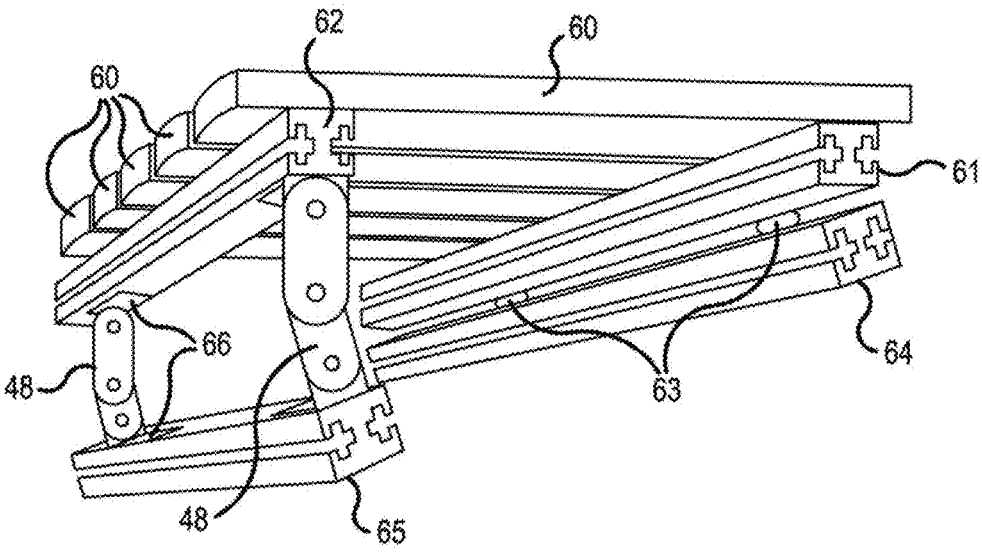
FIG. 9 is a perspective of a traverse walkway.

The riser units may be employed also for the construction of a traverse type walkway for extending horizontally over an inclined roof surface as shown in FIG. 9. Tread modules 60 are secured to a pair of auxiliary support beams 61,62 one 61 of which is pivotally secured by hinges 63 relative to a roof mounted primary support beam 64 secured to a roof structure. The other auxiliary support beam 62 is maintained elevated relative to another roof mounted primary support beam 65 by riser units that correspond substantially with the aforedescribed riser units 48. In this configuration the ends of each riser unit are not secured directly to the groove in a beam side wall. Instead end brackets 66 are employed each to pivotally connect with an end of a leg section and secure it to either the underside of beam 62 or upper face of beam 65.

Figure 10:
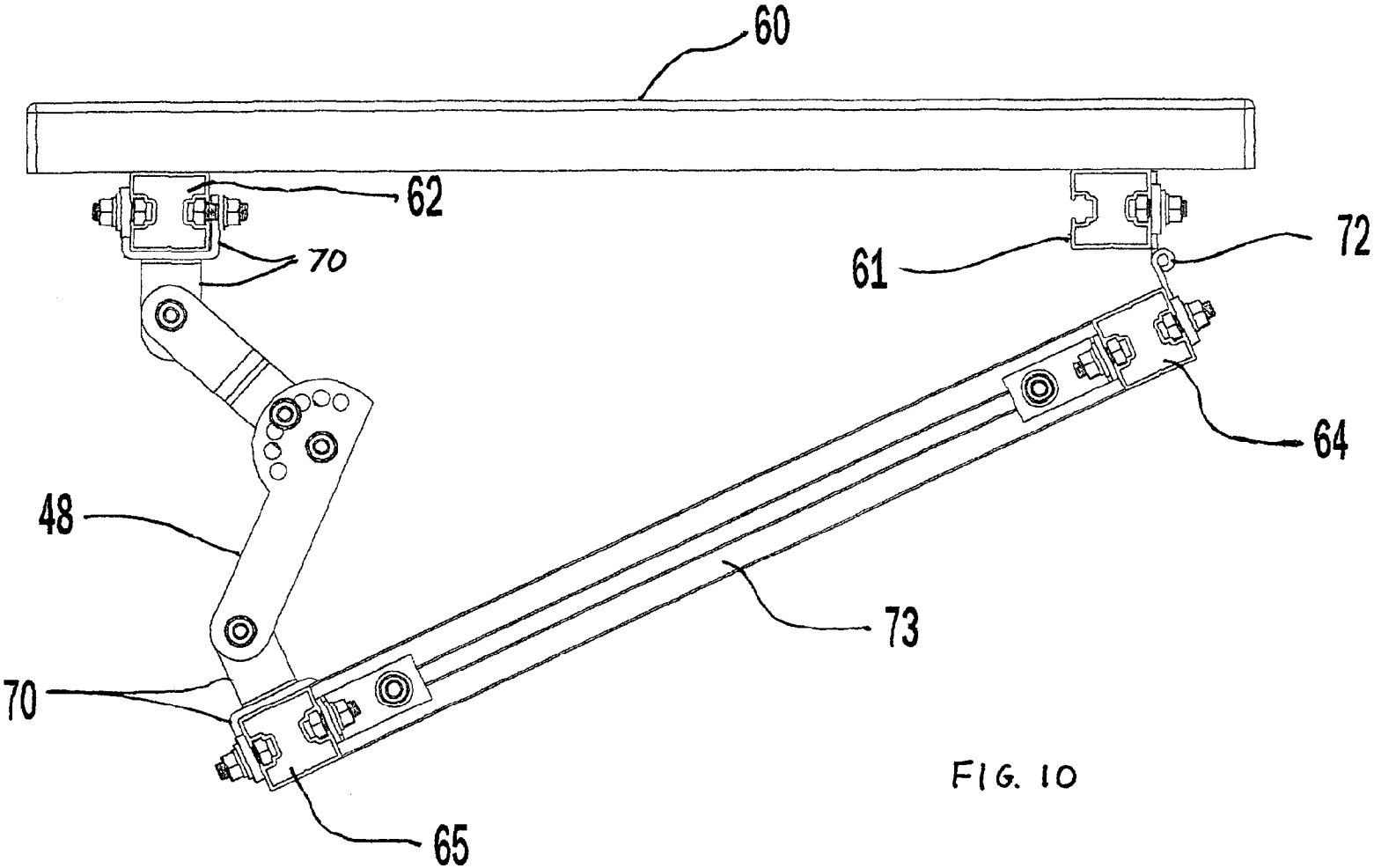
FIG. 10 is an end view of another transverse walkway.

In an alternative construction for a traverse walkway module, see FIG. 10, U shaped brackets 70 are attached to the respective ends of each riser unit 48 and allow attachment to the grooved side walls of the beams 62, 65. Also, instead of the aforedescribed hinge 63, use is made of hinges 72 which are secured to the grooved side walls of the beams 61, 64. In this and the aforedescribed embodiment the primary support beams 64,65 are each secured, in use, directly to a roof surface and additionally are maintained spaced apart by cross beams 73 having grooved side walls. That is, the cross beams form part of a prefabricated traverse walkway module.

The invention claimed is:

1. A walkway assembly, either attached to or adapted for attachment to a support structure, said assembly comprising:

a primary support for on-site attachment to the support structure;

a plurality of tread modules, each attached relative to the primary support and moveable between a first position, and a second position at which a part of each tread module is spaced further from the primary support than when at the first position; and a plurality of riser units for supporting the tread modules relative to the primary support in at least the second of the first and second positions, said primary support comprising a primary support member which comprises a groove formation for location of the primary support relative to at least one of the support structure and another support member, and said groove formation defining a channel that is generally of a C shape in cross-section, whereby, within the groove formation, there are two abutment surfaces, each of which lies at a respective side of an opening of the groove formation in a face of the respective side, each of said riser units being pivotally secured to said abutment surfaces of the groove formation of the primary support member, each of said riser units supporting a respective one of the tread modules, whereby an inclination of one of the tread modules relative to one or more other of the tread modules is independently adjustable.

2. The walkway assembly according to claim 1, wherein said two abutment surfaces are co-planar and provides said location of the primary support member relative to at least one of the support structure and another support member.

3. The walkway assembly according to claim 1, wherein the primary support comprises two primary support members which lie side by side in a spaced apart relationship and extend parallel with one another in a direction of the length of the walkway assembly, each of said tread modules being secured pivotally relative to the primary support.

4. The walkway assembly according to claim 1, wherein the primary support member comprises two side faces, each having said groove formation which is generally of said C shape in cross-section.

5. The walkway assembly according to claim 1, wherein each of said tread modules is supported by an auxiliary support, which is pivotally secured to the primary support for pivotal movement relative to the primary support, and comprises two auxiliary support members which lie side by side in spaced apart relationship and extend in parallel with one another, at least one of the auxiliary support members comprising an auxiliary groove formation for location of the auxiliary support member relative to the primary support, said auxiliary groove formation defining a channel which is generally of a C shape in cross-section, whereby within the auxiliary groove formation there are two auxiliary abutment surfaces, each of which lies at a respective side of an opening of the auxiliary groove formation in a face of the respective side, said two auxiliary abutment surfaces being co-planar, and wherein the primary support comprises two primary support members which lie side by side in a spaced apart relationship and extend parallel with one another in a direction of the length of the walkway assembly, wherein each said tread module is secured pivotally relative to the primary support, and wherein said auxiliary support members extend substantially parallel with the length of the primary support.

6. The walkway assembly according to claim 5, wherein the at least one auxiliary support member comprises two side faces each having a groove formation.

7. The walkway assembly according to claim 5, wherein said auxiliary groove formation of the at least one auxiliary support member is provided in a side face which extends substantially perpendicular relative to an upper support surface of the at least one auxiliary support member.

8. The walkway assembly according to claim 5, wherein the primary support member has a cross-sectional shape that is symmetrical about both of two mutually perpendicular axes.

9. The walkway assembly according to claim 5, wherein each auxiliary support member is pivotally secured to the primary support for pivotal movement about respective axes which extend substantially perpendicular to the length of the primary support, and wherein each of said auxiliary support members provides support for and has secured thereto at least one tread module.

10. The walkway assembly according to claim 5, wherein at least one of said auxiliary support members is secured pivotally to the primary support for pivotal movement about an axis which extends substantially perpendicular to the length of the primary support, wherein at least one of the riser units is configured to maintain part of said auxiliary support elevated above a part of the primary support, and wherein said at least one riser unit is of adjustable effective length.

11. The walkway assembly according to claim 1, wherein said groove formation is open ended to allow for ease of insertion of a connector for connecting two lengths of support members or for connection to a retainer by means of which a primary support member is configured to be retained relative to the support structure.

12. The walkway assembly according to claim 1, further comprising:

a riser unit of said plurality of riser units is of an adjustable effective length.

13. The walkway assembly according to claim 12, wherein the riser unit of said plurality of riser units comprises an articulated assembly of two leg sections having a relative angle of which is selectively adjustable, wherein an end of a first of said two leg sections of the riser unit of said plurality of riser units is pivotally securable to the primary support, and an end of a second of said two leg sections is pivotally securable relative to one of the tread modules, and wherein other ends of the two leg sections each comprise a pivot position whereby the two leg sections are configured to pivot relative to one another.

14. The walkway assembly according to claim 13, further comprising:

locking means to enable the two leg sections of the riser unit of said plurality of units to be locked in parallel with one another and/or at a chosen angle of relative inclination.

15. The walkway assembly according to claim 14, wherein the locking means comprises a fastener for extending through an aperture provided the first leg section at a position off-set from the pivot position in said other end of the first leg section and one of a series of apertures provided in said other end of the second leg section, said series of apertures comprising apertures each off-set from the pivot position of the second leg section and said apertures of the series being circumferentially spaced from one another about said pivot position of the second leg section.

16. The walkway assembly according to claim 1, wherein said walkway assembly is in the form of a pre-formed walkway assembly module.

17. The walkway assembly according to claim 16, wherein said walkway assembly module is adapted for structural interconnection with another pre-formed walkway assembly module.

18. The walkway assembly according to claim 1, wherein said walkway assembly is in the form of a module adapted for structural inter-connection with another pre-formed walkway assembly module.

* * * * *